United States Patent [19]

Smiltneek

[11] 4,009,876

[45] Mar. 1, 1977

[54] SHEET FEEDING MECHANISM

[75] Inventor: Ralmond J. Smiltneek, Butler, Wis.

[73] Assignee: Uniplex, Inc., Milwaukee, Wis.

[22] Filed: Mar. 24, 1975

[21] Appl. No.: 561,411

[52] U.S. Cl. ..... 271/99; 271/108; 271/132; 271/144

[51] Int. Cl.[2] ..... B65H 3/12

[58] Field of Search ..... 271/99, 102, 107, 108, 271/132, 133, 144, 171

[56] References Cited

UNITED STATES PATENTS

| | | | |
|---|---|---|---|
| 1,999,836 | 4/1935 | Guilbault | 271/99 |
| 2,956,804 | 10/1960 | Ridenour | 271/99 |
| 3,226,108 | 12/1965 | Bishop | 271/99 |
| 3,726,454 | 4/1973 | Robbins | 271/171 |
| 3,874,655 | 4/1975 | Allen et al. | 271/99 |

*Primary Examiner*—Robert W. Saifer
*Attorney, Agent, or Firm*—Fred Wiviott

[57] ABSTRACT

A mechanism for feeding blanks of corrugated cardboard and the like into a printing and container forming machine. The feeding mechanism includes a perforated suction head for moving individual sheets from a stack of sheets into the machine. The suction head includes a perforated plate and plenum chamber mounted on a tubular member which is telescopingly received over an open ended tubular support member, mounted on a hollow reciprocating shuttle. A valve is disposed at the shuttle end of the tubular support for connecting the shuttle to an evacuator and is actuable by a cam contoured such that the valve is actuated each time the suction head cycles. The blanks are supported with their forward ends at the shuttle and at their opposite ends by a universally adjustable support which compensates for warped blanks. A dump valve for venting the shuttle to atmosphere is operable in timed relation to the vacuum valve by means of a linear cam located adjacent the shuttle.

16 Claims, 7 Drawing Figures

SHEET FEEDING MECHANISM

BACKGROUND OF THE INVENTION

This invention relates to sheet feeding apparatus and more particularly to apparatus for feeding blanks for corrugated cardboard and the like into printing and container fabricating machinery.

In the fabrication of containers of materials such as corrugated cardboard, container blanks are individually fed into fabrication machinery where they may be printed, die cut, folded and/or glued. Such feeders commonly feed the blanks from the bottom of a stack which is bulk loaded on a feeding table and apparatus are provided for sequentially feeding the sheets from the stack into the machine from the bottom of the stack. One type of such feeding mechanism includes a perforated suction head carried on a hollow shuttle. Such shuttles are normally located adjacent to the fabricating machinery nip rolls and below the stack of blanks. The shuttle is commonly cycled back and forth toward the nip rolls while vacuum is initially applied to the interior of the shuttle for gripping the lowermost blank when the shuttle is in its rearmost position and the hollow shuttle interior is vented as it moves toward a forward position for releasing the blank whereupon it may be engaged by the nip rolls for movement into the fabricating machinery.

In prior art apparatus, valves connected the shuttle to a vacuum pump through elongate tubing. This provides a substantial volume that must be evacuated during each shuttle cycle and produces a substantial flow resistance. Further, some prior art suction feeders required filters between the vacuum pump and the shuttle to remove paper scraps and lint which filters also increased flow resistance. As a result of these difficulties, prior suction feeders had difficulties in clamping onto sheets, particularly if the latter were warped.

SUMMARY OF THE INVENTION

It is an object of the invention to provide a new and improved blank feeder.

Another object of the invention is to provide a suction type blank feeder for container fabricating machinery wherein flow resistance and evacuating requirements are minimized.

Another object of the invention is to provide a suction feeding apparatus for feeding blanks into a container fabricating apparatus wherein a filter is not required between the vacuum system and the suction feeder.

Yet another object of the invention is to provide an apparatus for feeding blanks which is adjustable to compensate for severely warped articles These and other objects and advantages of the invention will become more apparent from the detailed description thereof taken with the acompanying drawings.

DETAILED DESCRIPTION OF THE PREFERRED EMBODIMENTS

Figure 1:
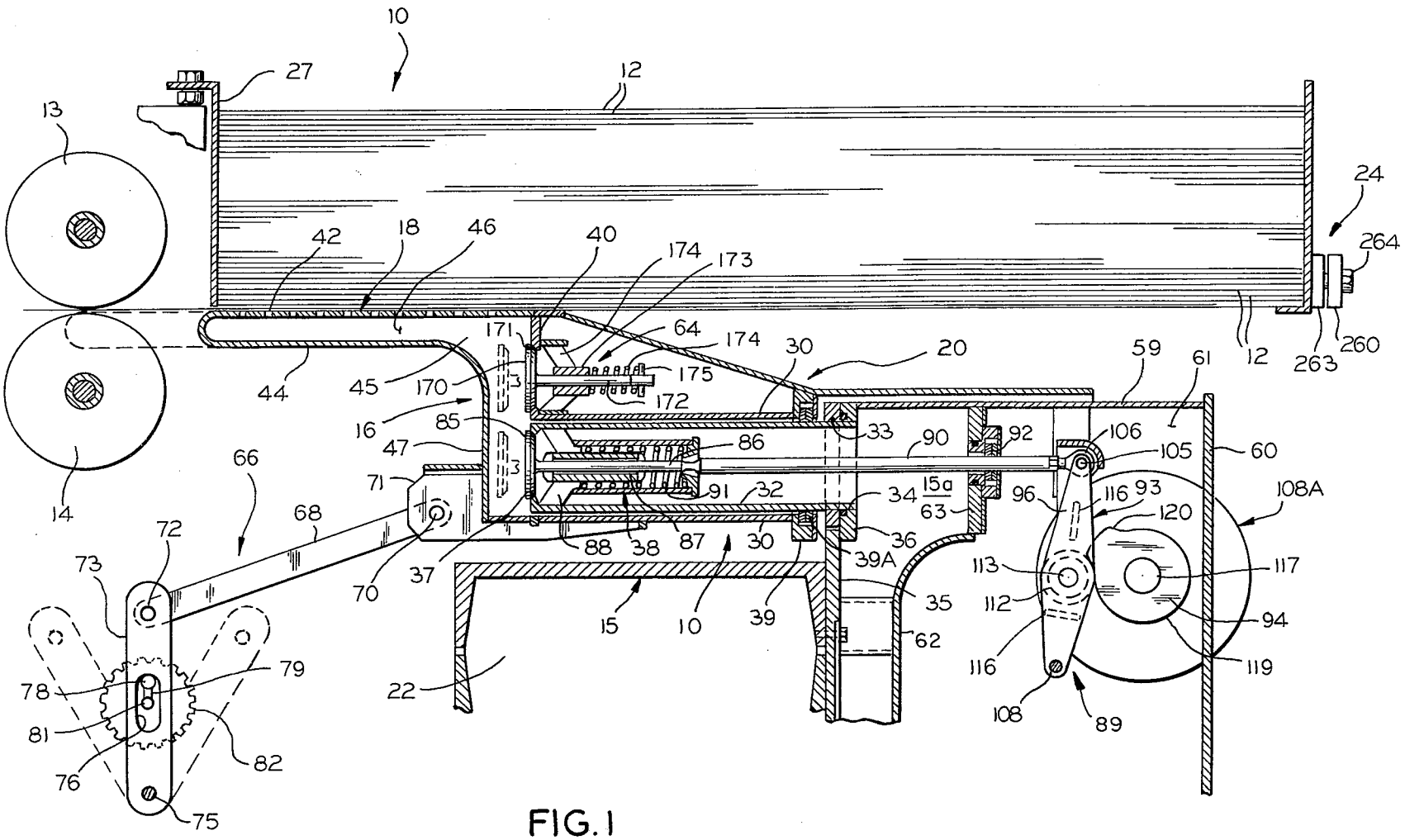
FIG. 1 is a side elevational view with parts broken away of a sheet feed mechanism according to a preferred embodiment of the invention.
Figure 5:
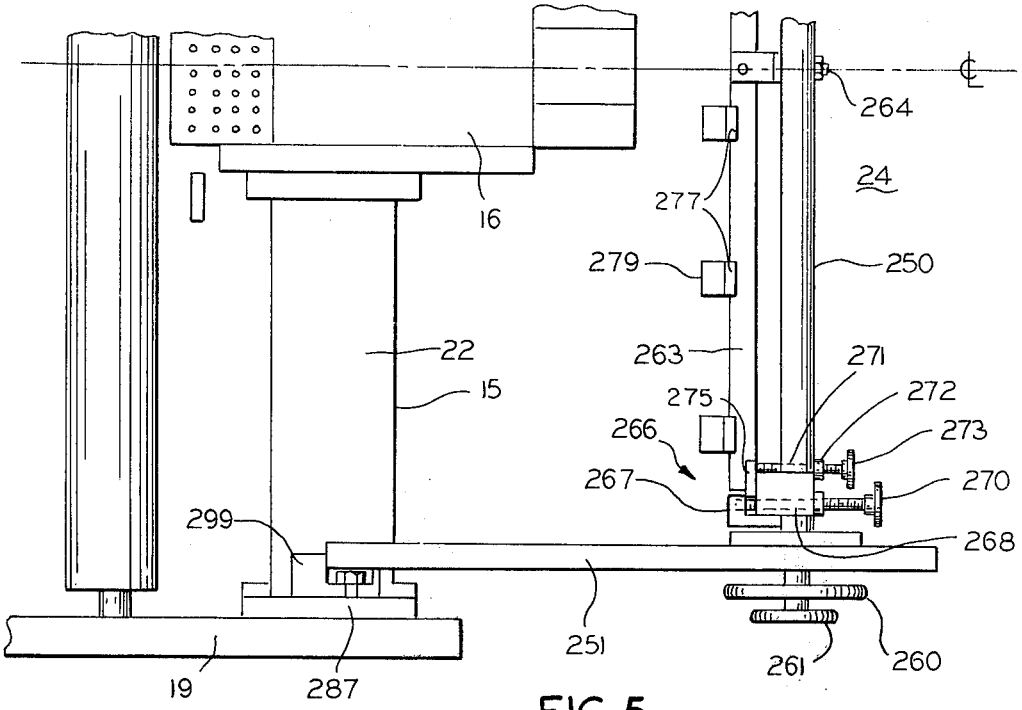
FIG. 5 is a top plan view of the sheet adjusting mechanism of the apparatus of FIG. 1.

FIG. 1 schematically illustrates the feeding mechanism 10 for feeding blanks 12 of corrugated cardboard from a stack of such blanks to the feed rolls 13 and 14 of processing apparatus (not shown) which may, for example, print, cut or fold the blanks 12 into cartons. The feeding mechanism 10 is supported on a box beam suction tank 15 which also forms a part of the support for mechanism 10 and includes a reciprocating shuttle assembly 16 having a suction head 18. The box beam suction tank 15 is shown in FIG. 5 to extend between and to be suitably affixed to the side frame portions 19 of the main apparatus being fed. A valve assembly 20 is operative in timed relation to the movement of the suction head 18 such that as the suction head moves forward from its position shown by full lines in FIG. 1, valve assembly 20 couples the suction head to an enclosure 22 formed by the walls of box beam 15 and which functions as a vacuum surge tank whereby the suction head 18 lockingly engages the lowermost blank 12 and moves the same toward the rolls 13 and 14 as the shuttle assembly 16 reciprocates. The valve assembly 20 is also operative to vent the shuttle head 18 as the latter approaches its forward position shown by broken lines in FIG. 1 whereby the blank 12 may be engaged by the nip of rolls 13 and 14 and moved into the subsequent processing machinery. The rear portion of the blanks 12 rest on an adjustable support assembly 24 while the forward ends of the blanks 12 engage one or more vertically adjustable elongate stop members 27 whose lower ends are disposed a distance above the upper surface of shuttle 16 which is slightly greater then the thickness of each of the blanks 12.

Figure 2:
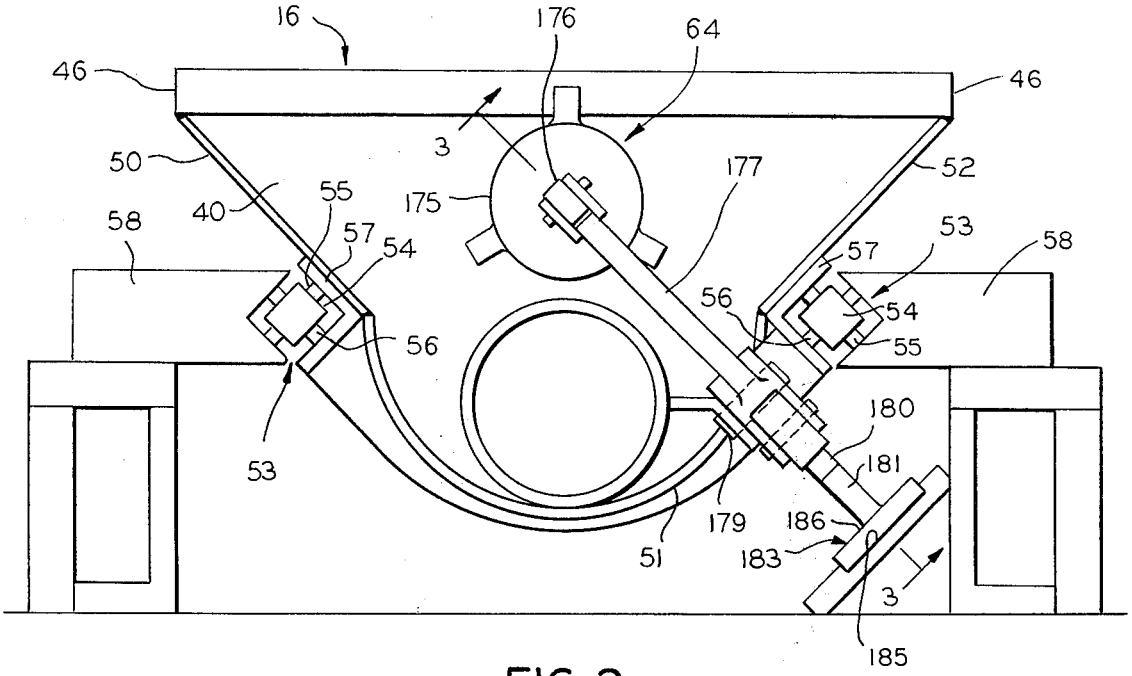
FIG. 2 is a front view of a portion of the apparatus shown in FIG. 1.

The shuttle 16 includes a hollow, open-ended cylindrical body member 30 telescopingly received on a cylindrical, tubular, open-ended valve support member 32 which extends horizontally through and is affixed in aligned circular apertures, 33 and 34 formed respectively in the one wall 35 of the valve mechanism frame and in a support plate 36 affixed to said wall. Support member 32 extends toward the feed rolls 13 and 14 and its other end terminates in a valve seat 37 for cooperating with one of the valves 38 of the valve assembly 20. An annular seal 39 is affixed to one end of the body member 30 and the opposite end thereof is received in a lower portion of a vertically oriented shaped plate 40 disposed intermediate the ends of the shuttle assembly 16. The suction head 18 extends forwardly from the upper end of plate 40 and includes a perforated top plate 42 and a bottom plate 44 spaced from the top plate 42 to define a first portion of a plenum chamber 45 therebetween and which is enclosed by generally vertical side plates 46. The rear edge of the bottom plate 44 is spaced from the plate 40 and merges with a generally downwardly extending plate 47 which is spaced from and is parallel to plate 40. The lower end of plate 40 is shown in FIG. 2 to be generally semicircular while the upper end thereof flares outwardly to the lower edges of the side plates 46. The gap between plates 40 and 47 are enclosed by side members 50, 51 and 52 which are configured as viewed in FIG. 2 to define a second portion of plenum chamber 45.

The shuttle 16 is mounted on the support frame 15 for longitudinal, low frictional movement by means of caged roller bearings 53. While any suitable roller bearing may be employed, in the illustrated example, the bearings 53 each include an elongate hollow tubular member 54 which is generally square in transverse cross-section and which has a pair of rollers 55 and 56 disposed at each end and each of which extends through a different pair of opposite sides. The bearings 53 are disposed between elongate angle members 57 affixed to and extending longitudinally along the sides of shuttle 16 and a complimentary angle track member 58 affixed to the frame 15 and extending in parallelism with the angle members 57. It will be appreciated that the rollers 55 and 56 are pinned in the tube 54 for rotation about axes which are each normal to a different pair of opposite sides of the tube 54 so that roller 55 (and its counterpart at the opposite end of tube 54) engage opposed faces of the angle member 57 and track member 58 while the roller 56 engages the other two opposed faces of said members. It will also be appreciated that means (not shown) are provided to retain the bearings 53 between members 57 and 58.

In addition to the front wall 35, the valve mechanism frame includes a top panel 59, a rear panel 60 and side panels 61. The open end of the tubular support 32 is coupled to the suction tank 15 by an enclosure 15a consisting of a panel 62 spaced from wall 35 and curved outwardly at its upper end for being welded to a vertical plate 63. Panel 62 and plate 63 are suitably affixed in a sealing relation to the panels 59 and 61. It will be appreciated that enclosure 15*a* is connected to the vacuum tank 15 and the latter is coupled to a vacuum pump (not shown) or other suitable evacuator so that vacuum pressure will be maintained therein as well as within the interior of the tubular support 32.

The valve assembly 20 includes the vacuum valve 38 for coupling the plenum chamber 45 to the enclosures 15a and 22 when it is desired to have the suction head 18 secure one of the panels 12 and a dump valve 64 for venting the plenum chamber 45 to atmosphere when it is desired to release the blank 12. In order to maintain the vacuum within the tank 15 and enclosure 15a, the valves 38 and 64 are controlled to open only when the other is closed. It will be appreciated that the vacuum applied below the perforated top plate 42 will result in the blank 12 there-above to be held against the shuttle head 18 by the ambient air pressure.

The shuttle 16 is reciprocated in timed relation to the speed of the feed rolls 13 and 14 by means of a drive assembly 66 (FIG. 1) to which it is coupled by an elongate link 68 having one end pivotally connected at 70, to a bracket 71 affixed to plate 47 and cylindrical body member 30. The other end of link 68 is pivotally connected at 72 to the free end of a rocker arm 73, the other end of which is affixed to a shaft 75 which is journaled for rotation in fixed bearings (not shown). The lever 73 has an elongate slot 76 formed intermediate its ends and in which is disposed a roller 78 rotatably mounted at one end of an arm 79, the other end of which is affixed to a shaft 81. A gear 82 is affixed to shaft 81 and is coupled by any suitable means (not shown) to the main drive mechanism of the fabricating apparatus so that gear 82 and shaft 81 have a rotational speed as related to that of the rolls 13 and 14. It can thus be seen that as gear 82 rotates through one revolution the rock lever 73 will pivot forwardly and backwardly between its positions shown by broken lines in FIG. 1 whereby the shuttle 16 will similarly cycle between its positions shown by full and broken lines. It will be appreciated that if the apparatus being fed is a printer, for example, the shuttle should cycle once for each revolution of the printing rolls so that gear 82 will rotate at printing rod speed.

The valve 38 is shown in FIG. 1 to include a valve member 85 affixed to the end of a stem 86 which extends coaxially into support member 32. Stem 86 is supported for axial sliding movement within member 32 by means of an axially extending support 87 which is affixed by webs 88 within support member 32 and adjacent the valve seat 37. A valve operating mechanism 89 is disposed within the valve mechanism frame and is coupled to the end of stem 86 by means of a connecting rod 90 for opening the valve 85 during each cycle of the shuttle 16 and against the biasing force of a valve return spring 91. Rod 90 extends through a suitable seal 92 in plate 63 which maintains the vacuum in enclosure 15*a*.

Referring now to FIG. 1, the valve operating mechanism 89 is shown to include a linkage assembly 93 and a rotating cam 94. The linkage assembly 93 has a pair of generally parallel, spaced apart links 96 which are each pivotally mounted at their lower ends on fixed pivot shaft 108. A first pin 105 pivotally connects the upper ends of the links 96 to an eyelet 106 mounted on the end of connecting rod 90.

A roller 112 is also rotatably mounted on a pin 113 extending between the links 96. The links 96 may be retained in spaced apart relation by webbing portions 116 located at various points therealong.

The cam 94 is mounted on a shaft 117 and is coupled to the apparatus prime mover (not shown) in any suitable manner, whereby the rotational speed of cam 94 will be the same as that of the shuttle operating gear 82 so that cam 94 will rotate once for each shuttle cycle. The surface 119 of cam 94 engages the roller 112 and has a generally annular configuration except for a larger diameter lifting lobe portion 120. It will be appreciated that as cam member 94 rotates in counterclockwise direction as viewed in FIG. 1 it will pivot the links 96 counterclockwise to open valve 38 during each cycle of the shuttle 16 as the lifting lobe 120 engages the roller 112.

It will be appreciated that because the valve 38 is located within the plenum chamber 45, the volume that must be evacuated during each cycle consists only of the plenum chamber itself and a portion of the body member 30. Further, the vacuum source commences at the enclosure 22 which is separated from the valve 38. Accordingly, the volume to be evacuated is minimized and in addition there is no long resistive flow path between the shuttle head and the vacuum system. Also, the volume of the plenum chamber 45 is relatively small in relation to the enclosure 22 in surge tank 15. As a result, a relatively strong vacuum can be reestablished in the plenum chamber during each cycle so that relatively strong clamping pressure is established on each blank being fed.

Figure 3:
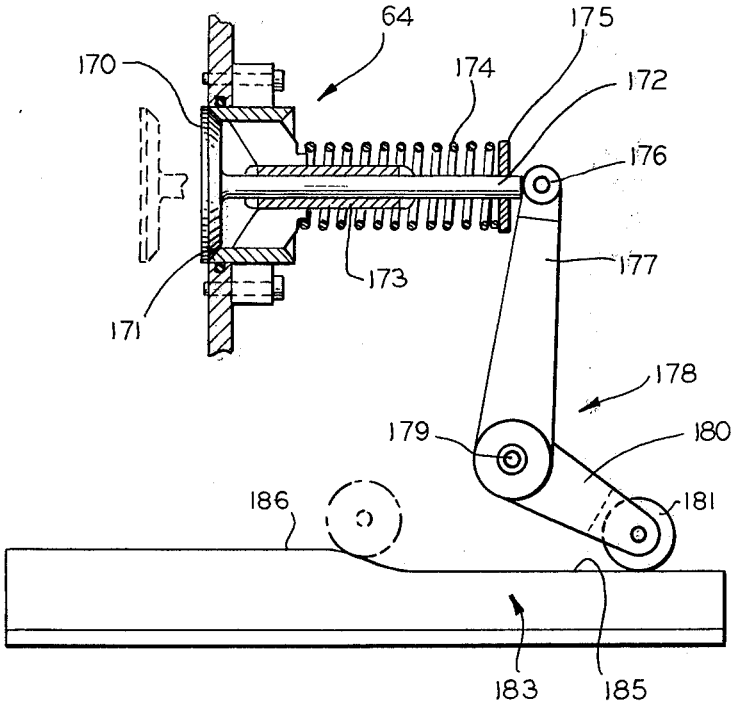
FIG. 3 is a view taken along lines 3—3 of FIG. 2.

The vent valve 64 is shown in FIGS. 1 and 3 to be similar to the vacuum valve 36 and includes a valve element 170 which cooperates with a valve seat 171 formed in plate 40. In addition, an axially extending valve stem 172 is coupled to valve element 170 and is supported for axial reciprocal sliding movement by a suitable support 173. A spring 174 extends between a spring retaining flange 175 affixed adjacent the end of stem 172 and support 173 and urges the valve 64 toward a closed position. The other end of valve stem 172 also includes a flat end face bearing against a roller 176 on one arm 177 of a crank 178 which is pivotally mounted at 179 to an angle member 56 mounted on shuttle 16. The other arm 180 of crank 178 carries a roller 181 at its free end for cooperatively engaging a cam track 183 which is affixed to the frame 15. Track 183 has a first portion 185 which corresponds to the rearmost position of the shuttle 16 and a second portion 186 which is elevated relative to the portion 185 and corresponds to the forward position of the shuttle 16. When the shuttle 16 is in its rearmost position relative to the rolls 13 and 14, the roller 181 will be on surface 185 and valve 64 will be closed. As the shuttle 16 moves forward, the roller 181 will move from the surface 185 onto the surface 186 causing the crank 178 to rock counterclockwise as viewed in FIG. 3 thereby moving the valve 64 to its open position wherein the plenum chamber will be vented to atmosphere through valve seat 71 and openings (not shown) in the surrounding housing so that the blank 12 being held by shuttle head 18 will be released. When the shuttle 16 traverses to its rearmost position after release of the blank 12, the roller 181 will move from the surface 186 onto the surface 185 whereupon the crank 176 will rock clockwise as viewed in FIG. 3 and the valve 64 will be closed. The track 183 will be configured such that the valve 64 will open and close in timed relation to the opening and closing of vacuum valve 38 as shown in FIG. 4.

Figure 4:
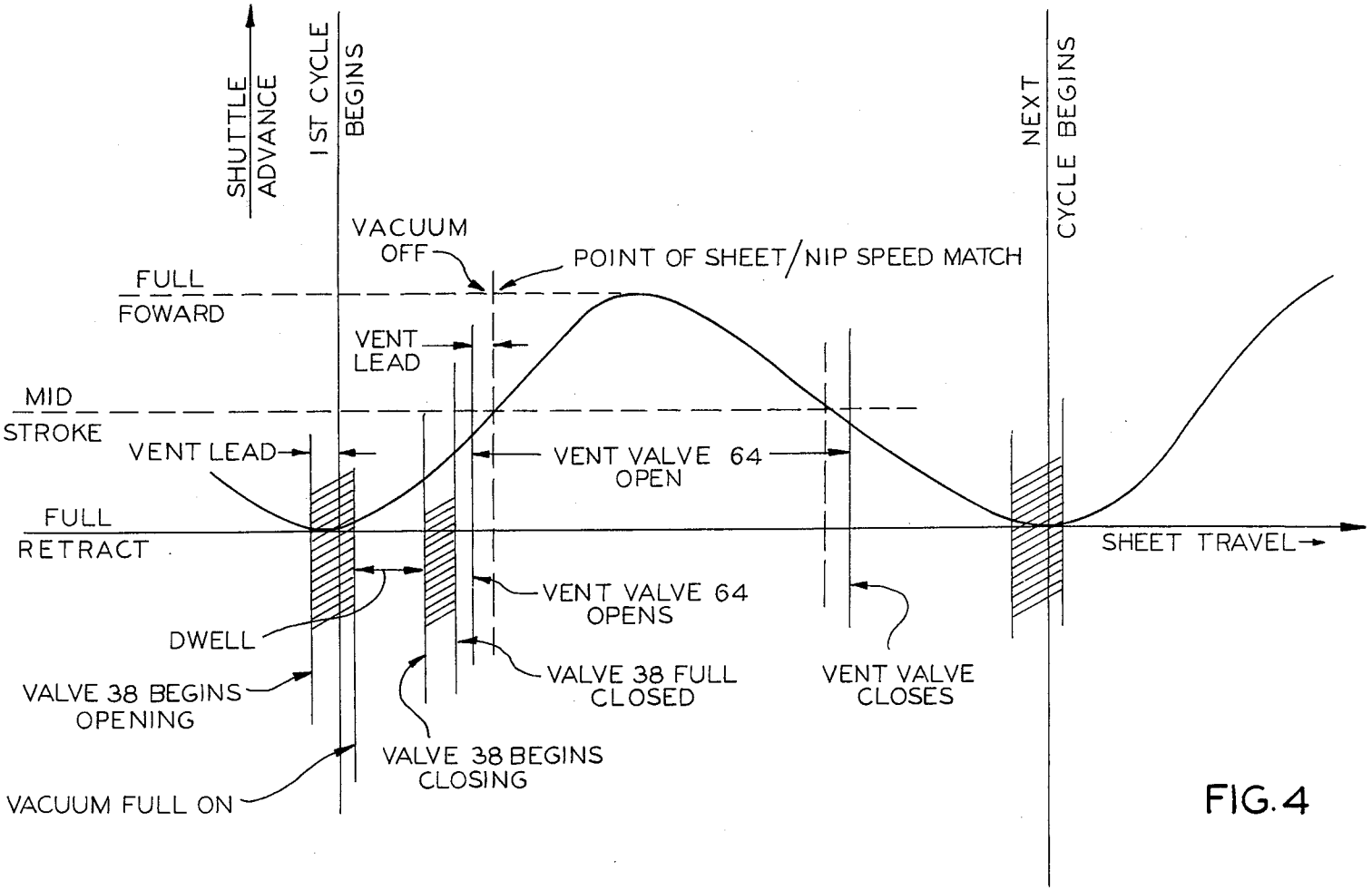
FIG. 4 illustrates the operative relationship between various portions of the apparatus.

FIG. 4 illustrates the relation between the advance of shuttle 16 and the operation of the vacuum valve 38 and the vent valve 64 in relation to apparatus having print rolls where the shuttle 16 completes one cycle for each revolution of the print rolls. It can be seen that the valve 38 will begin opening to connect the shuttle plenum chamber 45 to the vacuum enclosure 22 before the shuttle returns to its full retract position. The vacuum valve 38 will be fully opened shortly after the shuttle begins its forward advance and will remain open until the shuttle 18 has traveled to about 20% of its forward advance. At this point the vacuum valve 38 begins closing and will be fully closed when the shuttle 18 has moved about 30% of its forward traverse and after about 10% further travel, the vent valve 64 will begin opening whereby the blank 12 is released after about 50% forward travel and whereby the shuttle speed matches that of the rollers 13 and 14 which then pick up the blank 12. The vent valve 64 remains open until the shuttle has reversed its direction and has moved to a position slightly past the midpoint of its rearward traverse after which the next succeeding cycle commences.

FIGS. 1 and 5–7 show the rear adjustable support 24 generally to include a first support beam 250 which extends laterally across the apparatus. It is horizontally adjustable on side frame members 251 (FIGS. 5 and 6) by means of a rack 252 (FIG. 6) affixed to and extending along the lower face of side frame 251 and a pinion 253 which engages rack 252 and is rotatably mounted at the end of support beam 250. While only approximately half of the apparatus is shown in FIG. 5, it will be appreciated that the assembly is substantially symmetrical and that a second side frame member having a rack and pinion is disposed on the opposite side. The pinion 253 and that at the opposite side are mounted on a shaft 254 which extends through and is journaled in beam 250. A first hand wheel 260 is affixed to shaft 254 for rotating the same whereby beam 250 will be moved laterally. A second hand wheel 261 is coupled to a locking means (not shown) but well known in the art for locking pinion 253 against rotation whereby beam 250 is held in position. In the manner the rear support 24 may be moved toward and away from the shuttle 16 to accommodate blanks of different lengths.

Figure 6:
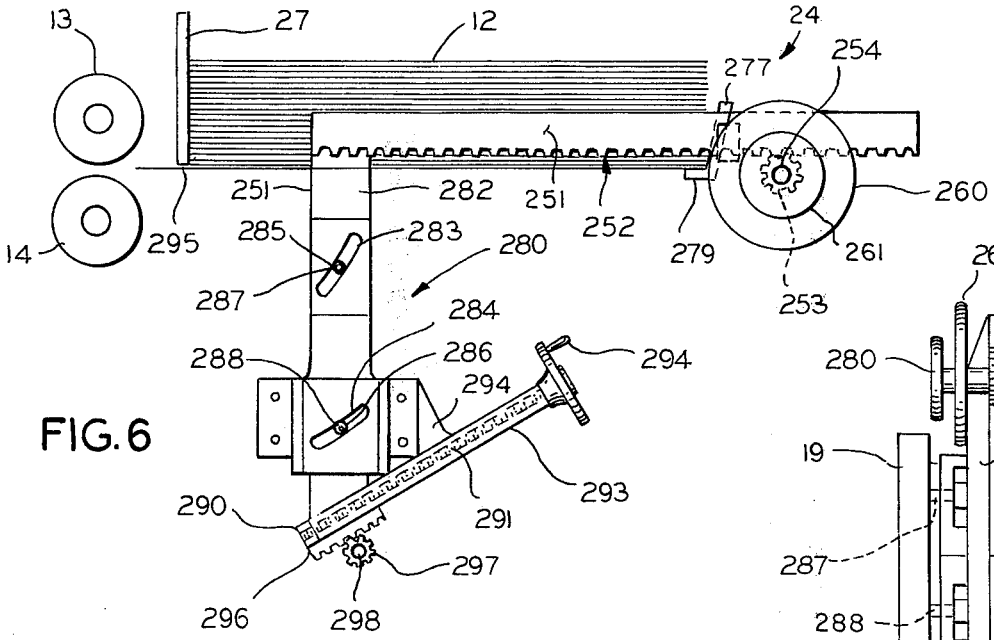
FIG. 6 is a side elevational view of the mechanism illustrated in FIG. 5.
Figure 7:
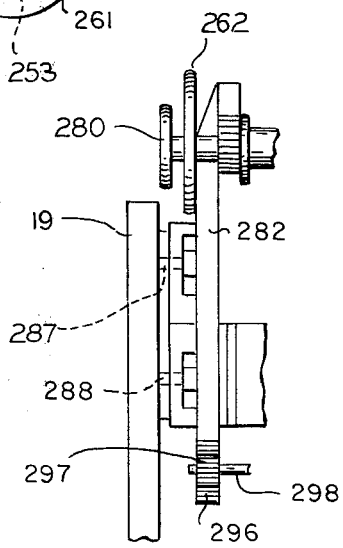
FIG. 7 is an end view of a portion of the mechanism shown in FIG. 5.

In addition, a second support beam 263 is shown in FIG. 5 to be pivotally mounted intermediate its ends on the first beam 250 by means of a pivot pin 264. The beam 263 may be locked in its angularly adjusted position by means of a lock assembly 266 disposed at one end of beam 263. The lock assembly includes a generally L-shaped lock block 267 which threadably receives a screw 268 which extends through beam 250 and which has a hand wheel 270 at its other end. A second screw 271 also extends through beam 250 and in parallelism with screw 268 and is received in a nut 272 integrally fixed to beam 250. A hand wheel 273 is mounted on the outer end of screw 271 while its inner end extends through beam 250 and bears against a flange 275 extending laterally from the end of beam 263. As can be seen in FIG. 5, the lock block 267 is disposed in the opposite side of flange 275. It will be appreciated therefore that when screw 271 is tightened it will force flange 275 against lock block 267 and accordingly, the beam 263 will be locked against rotation about pin 264. As also shown in FIGS. 5–7, a pair of rear stop members 277 are secured to the inner face of beam 263 and each carries an inwardly extending support shoe 279 at the lower end thereof.

The support shoes 279 will nominally be located in the same plane as the upper surface of the shuttle head 18. However, if the blanks 12 are warped, the screw 271 will be loosened and the beam 263 rotatably adjusted so that the front edges of the blanks 12 may be generally parallel to the gap between the front stop 27 and shuttle 18 while the rear portion is tilted to accommodate for the degree of warp whereupon the screw 271 is then tightened to its clamping position. In this manner, the blanks 12 may be fed easily into the process apparatus regardless of warping that may exist therein.

The rear support assembly 24 is also adjustable in a vertical arcuate path whose center of curvature is located at the lower edge of the front stop 27 by means of an adjustment assembly 280. More specifically, the assembly 280 includes a pair of vertical support posts 282 which are affixed at the forward ends of the side frame members 251 and extend downwardly therefrom. Each of the support posts 282 has a pair of spaced apart slots 283 and 284 which are preferably arcuate with their centers of curvature located at the lower end of front stop 27. A pair of spaced rollers 285 and 286 are mounted on fixed pins 287 and 288 extending from each of the main apparatus side frame members 19 and are received within the slots 283 and 284 respectively. A nut 290 is affixed to one of the vertical support posts 282 while a screw shaft 291 is journaled within an elongate sleeve 293 which is affixed by a bracket 294 to the adjacent side frame member 19 and is threadably received in nut 290. Hand wheel 294 is affixed to the end of screw shaft 291 so that rotation of the hand wheel will move the screw shaft into or out of the fixed nut 290 thereby imparting a rocking motion to the assembly consisting of the side frame members 251, the vertical post members 282 and the rear support assembly 24. This rocking action is also imparted to the side frame member 251 and vertical support post 282 at the opposite side of the assembly by means of a rack 296 affixed to the lower portion of the outer surface of nut 290 and a pinion 297 which engages the rack 296 and which is mounted on the end of a shaft 298 journaled for rotation on the main apparatus side frame members 19. The shaft 298 extends to the opposite side of the apparatus where a second pinion (not shown) engages a second rack (not shown) and which is affixed to the lower end of the support post 282 at the opposite side of the apparatus. As seen in FIG. 5, the vacuum tank support frame 15 has a slot 299 adjacent its end for passage of the vertical support post 282 therethrough. This permits rocking movement of the support posts 282 when the hand wheel 294 is rotated but operates to prevent the posts 282 and the side frame members 251 from substantial lateral movement.

It will be appreciated from the foregoing that the rear support beam 263 which supports one end of the sheets 12 may be rotated around the pin 264 and in addition, may be elevated or depressed by operation of the hand wheel 294. Accordingly, the support 24 may be adjusted so that the front edges of the blanks 12 may be maintained in an oriented straight position relative to the front stop 27 regardless of the degree of warp that may exist in said blanks.

While only a few embodiments of the invention have been illustrated and described, it is not intended to be limited thereby but only by the scope of the appended claims.

I claim:

1. Apparatus for feeding blanks into process machinery and including translatable means including enclosure defining means and perforated blank engaging means mounted on an upper portion of said enclosure defining means for engaging said blanks and operative when said enclosure defining means is subjected to a vacuum to grip a blank, operating means for reciprocating said translatable means from an initial position and in a first direction toward said process machinery and for return movement to said initial position, elongated tubular means extending generally in the direction of movement of said translatable means, said tubular means being connected to a vacuum source and having an opening adjacent one end, said translatable means including sleeve means affixed to said enclosure defining means and telescopingly movable with respect to said tubular means for placing said enclosure defining means in communication with said tubular means through said opening, said enclosure defining means being disposed adjacent said tubular means opening and is in communication therewith when said translatable means is in its initial position, and evacuating valve means for sealing the opening in said tubular means and valve operating means for opening and closing said valve means in timed relation to the cycle of said translatable means.

2. The apparatus set forth in claim 1 and including second valve means for venting said translatable means to atmosphere, said valve operating means also being operative to open and close said second valve means in timed relation to the cycle of said translatable means and the opening and closing of said evacuating valve means.

3. The apparatus set forth in claim 2 wherein said valve operating means includes cam means extending in the direction of that said translatable means travels and cam follower means coupled to said second valve means, said cam means being configured such that said cam follower means will effect the opening of said second valve means after said translatable means has moved a predetermined distance towards said process machinery and wherein said cam follower will close said second valve means during return movement of said suction means away from said machinery.

4. The apparatus set forth in claim 3 wherein said cam follower means includes crank means pivotally mounted on said suction means, said crank means having one end coupled to said second valve means and the other end engageable with said cam means, said cam means having first and second cam surfaces, said crank means pivoting to open said valve means when the other end thereof moves from said first cam surface to said second cam surface and pivoting to close said second valve means when the other end of said crank means moves from said second cam surface to said first cam surface.

5. Apparatus for feeding blanks into process machinery and including translatable means including enclosure defining means and blank engaging means mounted on said enclosure defining means for engaging said blanks and operative when said enclosure defining means is subjected to a vacuum to grip a blank, operating means for reciprocating said translatable means in a first direction toward and away from said process machinery, elongated tubular means extending generally in the direction of movement of said translatable means and being connected to a vacuum source, said translatable means including sleeve means telescopingly movable with respect to said tubular means, said tubular means having an open end proximate to said translatable means, evacuating valve means for sealing the open end of said tubular means and valve operating means for opening and closing said valve means in timed relation to the cycle of said translatable means, said blank engaging means including a perforated top plate constructed and arranged for engaging the lower surface of a blank disposed thereabove, said enclosure defining means being disposed below said perforated plate, said tubular means comprising an elongated generally horizontally extending open ended tubular member communicating at one open end with said vacuum source, said evacuating valve means closing the other open end of said tubular member, said sleeve means being slidably mounted on said tubular member and having an open end and being coupled to said enclosure defining means, and connecting means for extending through said tubular member for coupling said evacuating valve means to said valve operating means.

6. The apparatus set forth in claim 5 wherein said valve operating means includes cam means coupled to said connecting means and being cyclically operable in functional relation to the cycle of said translatable means, said valve operating means being effective to open said evacuating valve means when said cam means is in a predetermined phase of its cycles.

7. The apparatus set forth in claim 6 wherein said connecting means includes an elongate rod extending through said tubular member and a pivotally mounted lever means having a cam follower engageable with said cam means, said lever means being pivotable in a first direction to open said valve means when said cam follower engages an operative area of said cam means.

8. The apparatus set forth in claim 7 wherein said apparatus is constructed and arranged to receive a stack of blanks positioned with one side thereof mounted above said perforated plate, and support means for the opposite side of said blanks, said support means being pivotable about a substantially horizontal axis so that the opposite ends of said one side of the stack of blanks may be elevated relative to the other one thereof, and means for locking said support means in a pivoted angular position, and means for moving said support means horizontally and toward and away from said translatable means.

9. The apparatus set forth in claim 8 and including means for moving said support means vertically relative to said plate.

10. Apparatus for feeding blanks into process machinery and including translatable means including enclosure defining means and blank engaging means mounted on said enclosure defining means for engaging said blanks and operative when said enclosure defining means is subjected to a vacuum to grip a blank, operating means for reciprocating said translatable means in a first direction toward and away from said process machinery, elongated tubular means extending generally in the direction of movement of said translatable means and being connected to a vacuum source, said translatable means including sleeve means telescopingly movable with respect to said tubular means, said tubular means having an open end proximate to said translatable means, evacuating valve means for sealing the open end of said tubular means and valve operating means for opening and closing said valve means in timed relation to the cycle of said translatable means, said tubular means having a valve seat mounted in said open end, said evacuating valve being movable away from said valve seat in a direction generally parallel to said first direction, and connecting means extending through said tubular means and being coupled to said valve operating means.

11. The apparatus set forth in claim 10 wherein said tubular means comprises a generally cylindrical member, said sleeve means being generally cylindrical and mounted on the outer surface of said tubular member, and sealing means mounted on one of said sleeve means and said tubular member for sealing the junction therebetween.

12. The apparatus set forth in claim 11 wherein said connecting means includes elongate rod means connected at one end to said valve and at said other end to said valve operating means, pivotally mounted link means connected at one end to said connecting means, roller means mounted on said link means, and cam means mounted for rotation in timed relation to said reciprocating means and operative when in a predetermined angular position for engaging said roller means to open said evacuating valve means, and means resiliently biasing said ovacuating valve means to a closed position.

13. The apparatus set forth in claim 12 and including a hollow frame member sealed and extending in a direction generally transverse to said first direction of movement, said frame member being coupled to an evacuator and to said tubular member to provide a vacuum surge tank therefor.

14. The apparatus set forth in claim 13 and including a hollow enclosure, said valve operating means being disposed in said enclosure, said enclosure being coupled between said hollow frame member and said tubular member to define a portion of said vacuum surge system.

15. Apparatus for feeding blanks from a stack into process machinery having feed rolls and including a suction means, means for supporting said blanks above said suction means, said suction means being operative when subjected to a vacuum to grip the lowermost blank in said stack and for releasing the same in a timed relation, translating means for reciprocating said suction means toward and away from said feed rolls, first and second frame means extending generally parallel to the direction of movement of said suction means and one being disposed on each of the opposite sides thereof, said support means including a first elongate member extending between said first and second frame means and in a direction generally normal thereto, means mounting the opposite ends of said first elongate member on said frame portions and operable for selectively moving said first elongate member in said direction, said support means including a second elongate member mounted on said first elongate member for pivotal movement about an axis generally parallel to said direction, and locking means operative to lock said second elongate member in its pivotal angular position, and blank engaging means mounted on said second elongate member and being pivotal therewith.

16. The apparatus set forth in claim 15 and including front stop means adjacent said feed rolls, said blanks being individually movable under said front stop means by said suction means for movement into a position to be engaged by said feed rolls, and means for rotating said frame means about an axis corresponding generally to the lower ends of the said front stop means.

* * * * *